US009742087B2

(12) United States Patent
Tagami et al.

(10) Patent No.: US 9,742,087 B2
(45) Date of Patent: Aug. 22, 2017

(54) CONNECTOR

(71) Applicant: Molex, LLC, Lisle, IL (US)

(72) Inventors: Hideyo Tagami, Yamato (JP); Yasuaki Kobayashi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/217,642

(22) Filed: Jul. 22, 2016

(65) Prior Publication Data

US 2017/0062963 A1 Mar. 2, 2017

(30) Foreign Application Priority Data

Aug. 24, 2015 (JP) ..... 2015-165249

(51) Int. Cl.
*H01R 12/88* (2011.01)

(52) U.S. Cl.
CPC ..... *H01R 12/88* (2013.01)

(58) Field of Classification Search
CPC ..... H01R 23/668; H01R 23/684
USPC ..... 439/495, 331, 67
See application file for complete search history.

(56) References Cited

U.S. PATENT DOCUMENTS

| | | | | |
|---|---|---|---|---|
| 7,530,831 | B2 | 5/2009 | Nishimatsu | |
| 8,651,885 | B2 | 2/2014 | Ashibu | |
| 8,662,916 | B2 | 3/2014 | Ashibu | |
| 8,986,031 | B2 | 3/2015 | Matoba et al. | |
| 9,252,516 | B2 | 2/2016 | Ashibu | |
| 9,531,096 | B2 | 12/2016 | Chen | |
| 2007/0066127 | A1 | 3/2007 | Inoue | |
| 2007/0173106 | A1 | 7/2007 | Wei | |
| 2011/0244709 | A1 | 10/2011 | Ashibu | |
| 2012/0100736 | A1* | 4/2012 | Ashibu | H01R 12/88 439/260 |
| 2015/0056840 | A1 | 2/2015 | Ohyama | |
| 2015/0118909 | A1 | 4/2015 | Yokoo | |

FOREIGN PATENT DOCUMENTS

| | | | |
|---|---|---|---|
| JP | 2002-246086 | A | 8/2002 |
| JP | 2006-073319 | A | 3/2006 |
| JP | 2010-153209 | A | 7/2010 |
| JP | 2013-211140 | A | 10/2013 |

* cited by examiner

*Primary Examiner* — Phuongchi T Nguyen
(74) *Attorney, Agent, or Firm* — James A. O'Malley

(57) ABSTRACT

A connector is provided which has an actuator able to rotate around a pressure-applying portion arranged below upper beams between an open orientation and a closed orientation, and a stopping portion. The actuator is able to move with the actuator in the closed orientation between a first position where the stopped portion of the actuator comes into contact with the stopping portion to prevent rotation of the actuator from the closed orientation to the open orientation, and a second position where the stopped portion of the actuator has moved away from the stopping portion to allow rotation of the actuator from the closed orientation to the open orientation.

15 Claims, 9 Drawing Sheets

FIG. 4C
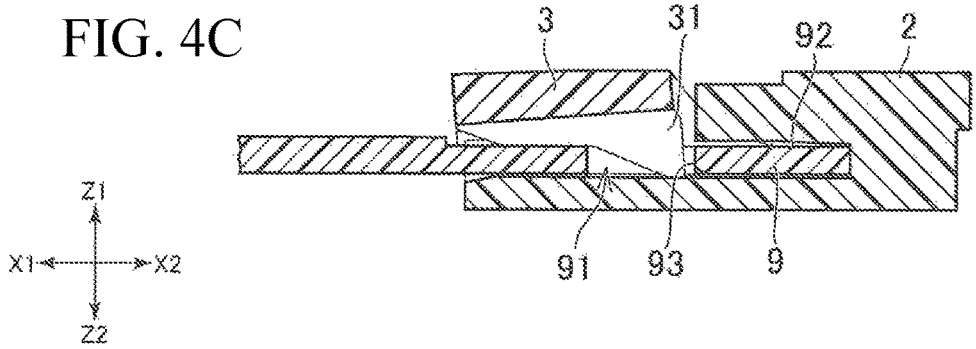
FIG. 4D
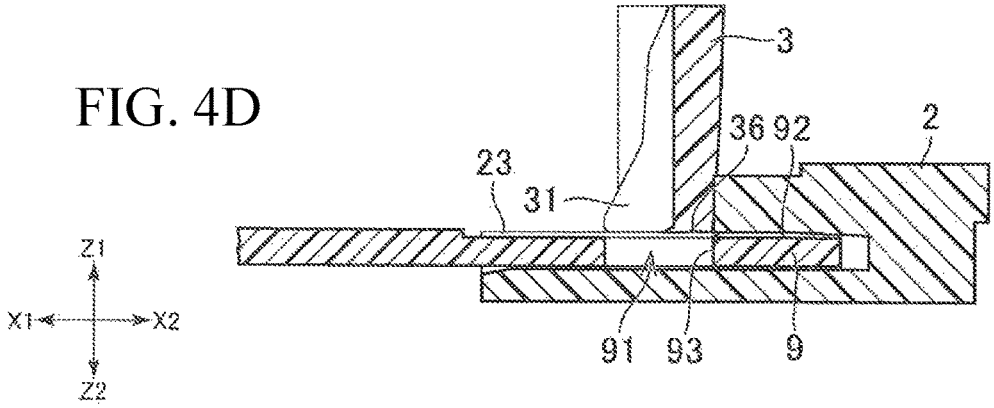
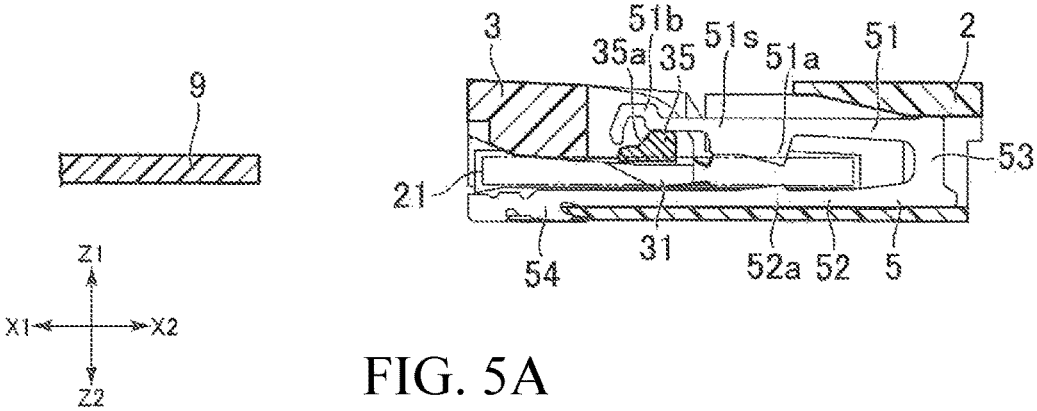
FIG. 5A

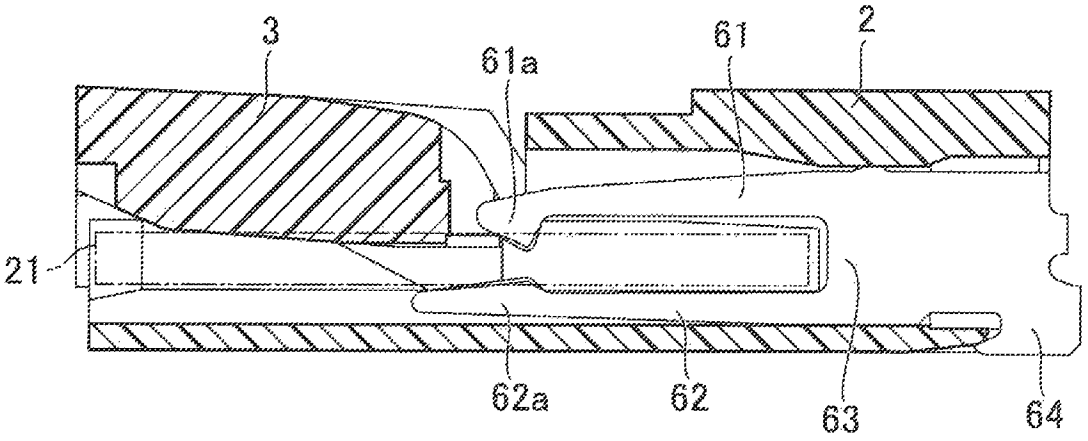
FIG. 6
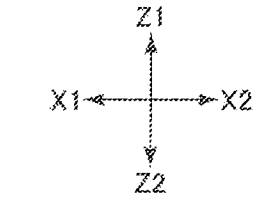

CONNECTOR

RELATED APPLICATIONS

This application claims priority to Japanese Application No. 2015-165249, filed Aug. 24, 2015, which is incorporated herein by reference in its entirety.

TECHNICAL FIELD

The present disclosure relates to a connector.

BACKGROUND ART

A connector for a flat cable usually includes an actuator for opening and closing the connector. For example, the actuator in the connector disclosed in Patent Document 1 has a cam shaft and the actuator opens and closes (rotates) around the cam shaft. The operator can insert a flat cable or remove a flat cable from the connector by moving the actuator to the open orientation. When the actuator is in the closed orientation, the cam shaft presses down on the flat cable and the flat cable presses down on the lower beams of the terminals. As a result, the flat cable is kept from moving in the detachment direction.

Patent Document 1: Laid-Open Patent Publication No. 2010-153209

SUMMARY

The actuator opening unintentionally is undesirable. However, the actuator has to be opened to release a flat cable from the connector when, for example, the flat cable is to be replaced.

The present disclosure provides a connector which can prevent an actuator from opening unintentionally and which allows the actuator to be easily opened when necessary.

The present disclosure is a connector comprising: a housing having an insertion passage for insertion of a flat cable from the front end, a plurality of terminals arranged inside the housing in the transverse direction, each having an upper beam positioned above the insertion passage, an actuator having a pressure-applying portion arranged on the lower side of the upper beams, the actuator being able to rotate around the pressure-applying portion between an open orientation and a closed orientation, and a stopping portion; the actuator being able to move with the actuator in the closed orientation between a first position where the stopped portion of the actuator comes into contact with the stopping portion to prevent rotation of the actuator from the closed orientation to the open orientation, and a second position where the stopped portion of the actuator has moved away from the stopping portion to allow rotation of the actuator from the closed orientation to the open orientation.

In another embodiment of the present disclosure, the actuator can move in the longitudinal direction between the first position and the second position with the actuator in the closed orientation.

In another embodiment of the present disclosure, the stopping portion is positioned in front of the stopped portion of the actuator.

In another embodiment of the present disclosure, each upper beam has a receiving portion caught by the pressure-applying portion of the actuator, the stopped portion of the actuator coming into contact with the stopping portion before the pressure-applying portion of the actuator comes into contact with the receiving portion of each upper beam when the actuator moves forward.

In another embodiment of the present disclosure, at least one of the stopping portion and the stopped portion includes an inclined surface extending upward and to the rear on the surface contacting the other one of the stopping portion and the stopped portion.

In another embodiment of the present disclosure, each of the plurality of terminals has a contact portion formed in the upper beam and positioned in the insertion passage, the actuator including an engaging portion positioned in the middle of the insertion passage and making contact with an end portion of the flat cable and being pushed up by the end portion of the flat cable prior to the contact portions of the upper beams when the flat cable is being inserted, and a pressure-applying portion arranged below the upper beams and pushing up the upper beams against the elastic force of the terminals when the engaging portion has been pushed up.

In another embodiment of the present disclosure, the pressure-applying portion of the actuator is downward away from the upper beams when the flat cable has been inserted.

In another embodiment of the present disclosure, the pressure-applying portion of the actuator pushes up the upper beams against the elastic force of the terminals when the actuator is in the open orientation.

BRIEF DESCRIPTION OF THE DRAWINGS

FIG. 4C is the cross-sectional view in FIG. 4A after insertion of the flat cable.

FIG. 4D is the cross-sectional view in FIG. 4A showing the actuator in the open orientation.

FIG. 5A is a cross-sectional view from V-V in FIG. 1.

FIG. 6 is a cross-sectional view from VI-VI in FIG. 1.

DETAILED DESCRIPTION OF THE PREFERRED EMBODIMENTS

Figure 1:
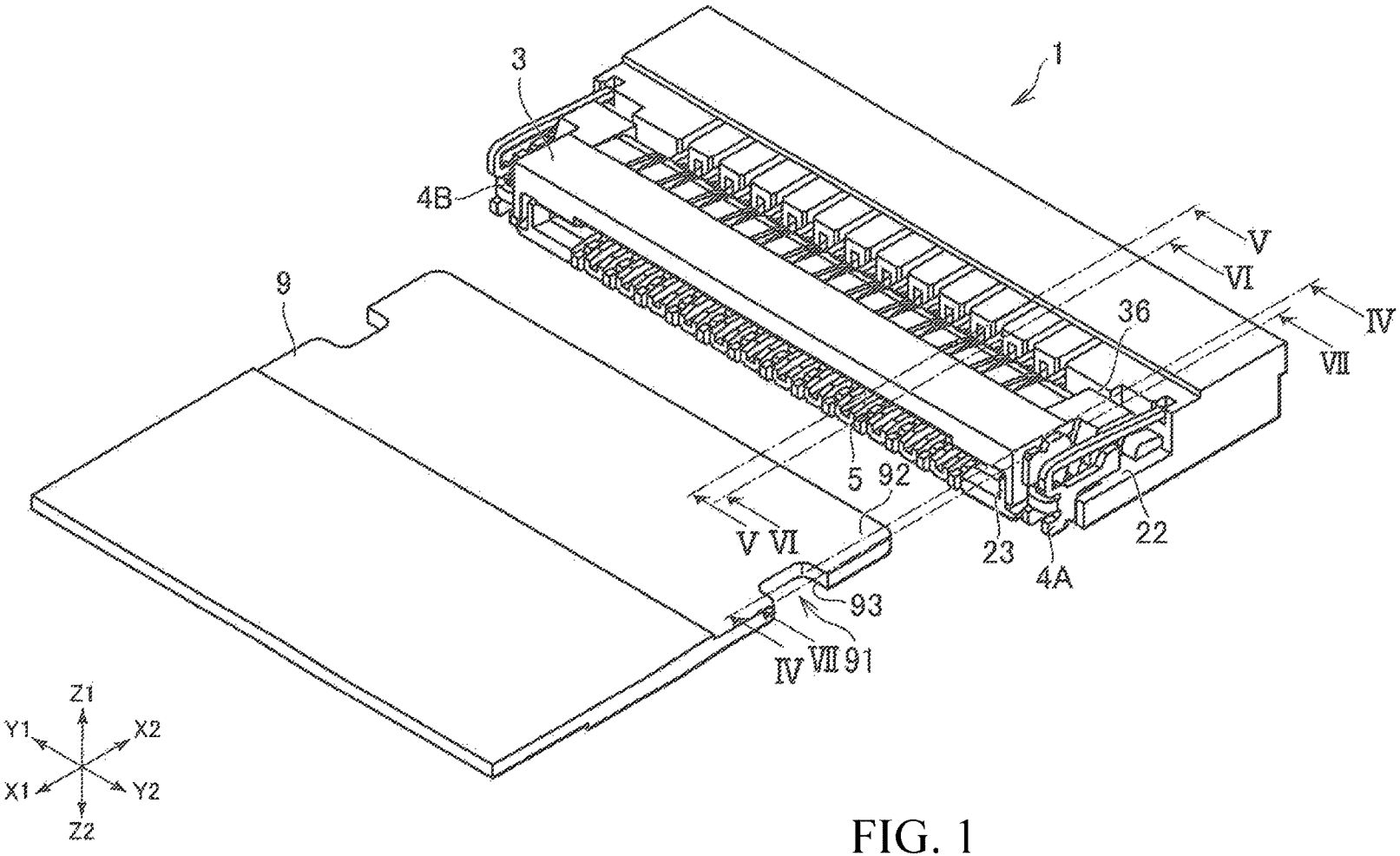
FIG. 1 is a perspective view of a connector and a flat cable in an embodiment of the present disclosure.
Figure 2:
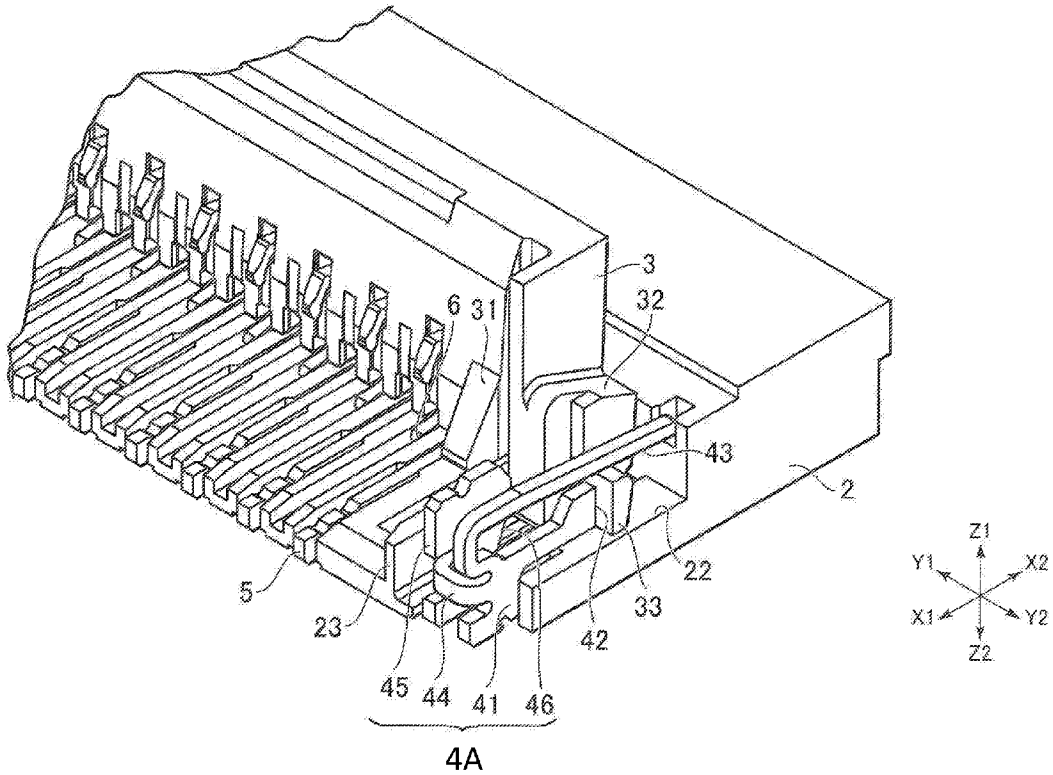
FIG. 2 is an enlarged view of the connector showing an actuator in the open orientation.
Figure 3:
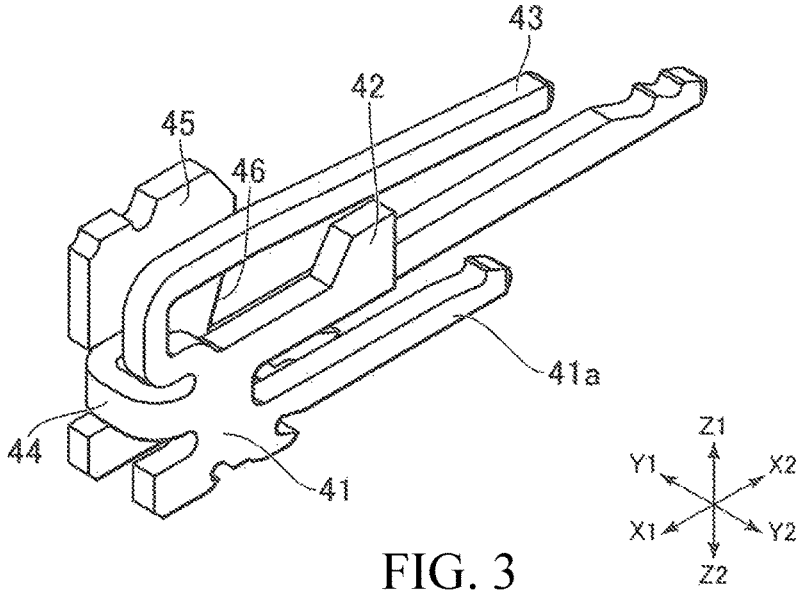
FIG. 3 is a perspective view of a holding member 4A arranged in the connector.

The following is an explanation of a mode of embodying the present disclosure (referred to below as an embodiment) with reference to FIG. 1 through FIG. 8C. FIG. 1 is a perspective view of the connector 1 and the flat cable 9 in an example of an embodiment of the present disclosure (referred to below as the present embodiment). FIG. 2 is an enlarged view of the connector 1. FIG. 3 is a perspective view of the holding member 4A arranged in the connector 1. FIG. 4A through FIG. 4D are cross-sectional views from IV-IV in FIG. 1 showing the positional relationship between the connector 1 and the flat cable 9. FIG. 5A through FIG. 5E are cross-sectional views from V-V in FIG. 1 showing the positional relationship between the connector 1 and the flat cable 9. FIG. 6 is a cross-sectional view of the connector 1 and the flat cable 9 from VI-VI in FIG. 1. FIG. 7A through FIG. 7D are cross-sectional views from VII-VII in FIG. 1 showing the positional relationship between the connector 1 and the flat cable 9. FIG. 8A through FIG. 8C are right side views of FIG. 1 showing the positional relationship between the connector 1 and the flat cable 9.

In each drawing, the directions denoted by X1 and X2 are, respectively, the front and rear directions, the directions denoted by Y1 and Y2 are, respectively, the left and right directions, and the directions denoted by Z1 and Z2 are, respectively, the up and down directions.

Figure 4A:
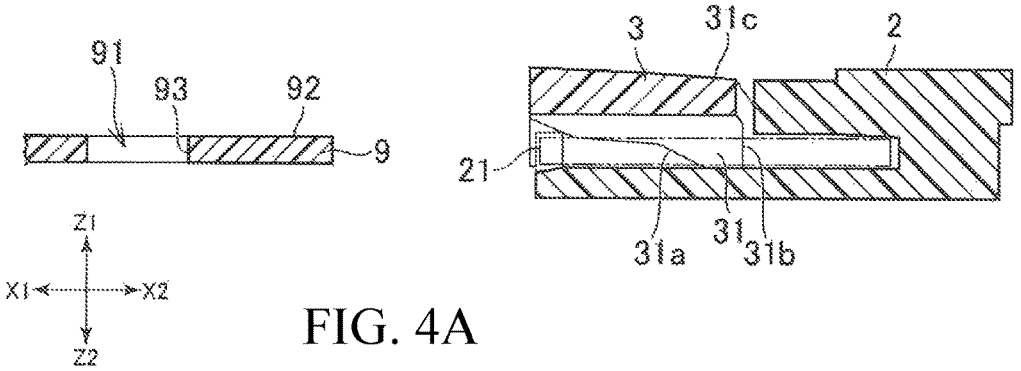
FIG. 4A is a cross-sectional view from IV-IV in FIG. 1.

As shown in FIG. 1 and FIG. 2, the connector 1 in the present embodiment includes a housing 2, an actuator 3, holding members 4A, 4B, primary terminals 5, and secondary terminals 6 (see FIG. 2). As shown in FIG. 2, the primary terminals 5 and the secondary terminals 6 are arranged in the transverse direction inside the housing 2, and each secondary terminal 6 alternates with a primary terminal 5. As shown in FIG. 4A, an insertion passage 21 is provided inside the housing 2 allowing the flat cable 9 to be inserted from the front end.

As shown in FIG. 1 and FIG. 2, the actuator 3 can rotate between a closed orientation in which the forward end or leading end has been pushed down in the forward direction (see FIG. 1) and an open orientation in which the leading end is raised (see FIG. 2). As shown in FIG. 2, an engaging portion 31, a stopped portion 32, and a supported portion 33 are formed in the actuator 3 for each primary terminal 5 and secondary terminal 6 on the left and right. Also, supporting portions 22 are formed on both the left end and the right end of the housing 2. Each supporting portion 22 is positioned below a supported portion 33 to support the supported portions 33 from below.

As shown in FIG. 2 and FIG. 3, the holding member 4A includes an outer plate portion 41 and an inner plate portion 45 which are two plate portions extending parallel to each other in the longitudinal and vertical directions. The outer plate portion 41 and the inner plate portion 45 are connected via a bridge portion 44. The holding member 4A includes inserted portions 41*a*, 45*a* extending to the rear from the outer plate portion 41 and the inner plate portion 45. These are inserted into the housing 2 where the leading ends are hooked inside the housing 2 to secure the holding member 4A to the housing 2.

As shown in FIG. 3, the holding member 4A also includes a pressing portion 42 and a spring portion 43 extending to the rear from the outer plate portion 41. A stopping portion 46 is formed in the inner plate portion 45 of the holding member 4A. As explained below, the stopping portion 46 restricts forward movement of the actuator 3.

The holding member 4B is formed symmetrically with respect to holding member 4A and has the same structure as holding member 4A. As shown in FIG. 1, holding member 4A is arranged to the left of the primary terminals 5 and the secondary terminals 6, and holding member 4B is arranged to the right of the primary terminals 5 and the secondary terminals 6.

As shown in FIG. 4A, the insertion passage 21 is provided in the housing 2 which covers the upper surface and the lower surface of the inserted flat cable 9 as well as the side surfaces on the rear end. When the actuator 3 is in the closed orientation, the engaging portion 31 formed in the actuator 3 is positioned in the middle of the insertion passage 21 in the longitudinal direction. The engaging portion 31 has a shape which protrudes downward. More specifically, there is an inclined surface 31*a* and a rear surface 31*b* extending rearward and downward when viewed from the side. Because of the inclined surface 31*a*, the flat cable 9 can be easily inserted. Because the rear surface 31*b* faces the edge 93 of the flat cable 9 described below, the flat cable 9 is kept from becoming detached.

Figure 4B:
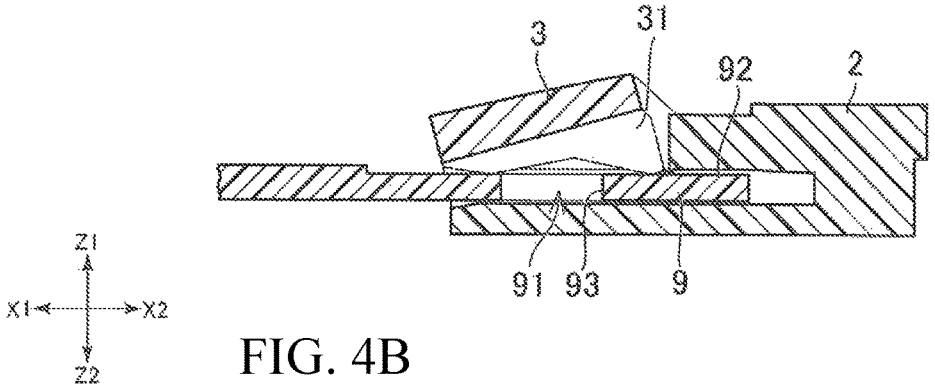
FIG. 4B is the cross-sectional view in FIG. 4A during insertion of the flat cable.

As shown in FIG. 4B, the flat cable 9 is inserted into the insertion passage 21 with the actuator 3 in the closed orientation. As the flat cable 9 is being inserted, the engaging portion 31 comes into contact with the end portion 92 on the rear end and right (or left) side of the flat cable 9 and is pushed upward by the end portion 92. Here, the contact position between the engaging portion 31 and the end portion 92 of the flat cable 9 is to the rear of the contact position between the pressure-applying portion 35 and the receiving portion 51*b* described below (see FIG. 5A and FIG. 5B). As a result, the rear end of the actuator 3 is raised when the engaging portion 31 is pushed upward. The orientation of the actuator 3 when the rear end is raised is referred to as the floating orientation.

When the flat cable 9 is pushed further to the rear inside the insertion passage 1 as shown in FIG. 4C, the engaging portion 31 is fitted into a notch 91 in the flat cable 9, and the actuator 3 moves from the floating orientation to the closed orientation. Because the outside edge 93 of the notch 91 remains in contact with the engaging portion 31 even when the flat cable 9 is pulled in the forward direction, the flat cable 9 is kept from becoming inadvertently detached. When the actuator 3 is in the closed orientation in the connector 1 of the present embodiment, the operator can insert a flat cable 9 into the connector 1 and lock the leading end of the inserted flat cable 9 inside the connector 1.

Also, when the actuator 3 is in the open orientation shown in FIG. 4D, the engaging portion 31 is positioned above the insertion passage 21. When the engaging portion 31 is retracted and removed from the insertion passage 21, the flat cable 9 is unlocked and the operation can remove the flat cable 9 from the connector 1.

As shown in FIG. 5A, the primary terminals 5 are arranged inside the housing 2. Each primary terminal 5 has an upper beam 51 positioned above the insertion passage 21, and a lower beam 52 positioned below the insertion passage 21. Here, a contact point portion 51*s* is formed in the upper beam 51 which protrudes downward from the upper beam and includes a contact portion 51*a* which makes contact with the upper surface of the flat cable 9. A contact portion 52*a* is formed on the lower beam 52 to make contact with the lower surface of the flat cable 9. The upper beam 51 and the lower beam 52 are connected via a support column portion 53 in the rear and the configuration is such that the flat cable 9 is clamped by the elastic force of the primary terminal 5. In other words, as shown in FIG. 5A, the interval between contact portion 51*a* and contact portion 52*a* is narrower than the thickness of the flat cable 9. Because the contact point portion 51*s* extends downward from the upper beam 51, the vertical position of the contact portion 51*a* and the elastic force of the upper beam 51 can be easily adjusted to the dimensions of the inserted flat cable 9.

Each primary terminal 5 is made from a conductive material such as a metal. At least one of contact portion 51*a* and contact portion 51*b* of each primary terminal 5 makes contact with a conductive wire or conductive surface (not shown) on the upper surface or lower surface of the flat cable 9 to establish an electrical connection between the primary terminal 5 and the flat cable 9. A securing portion 54 is formed on the front end of the lower beam 52 to engage the housing 2 and secure the connector 1 to the board (not shown).

Figure 5B:
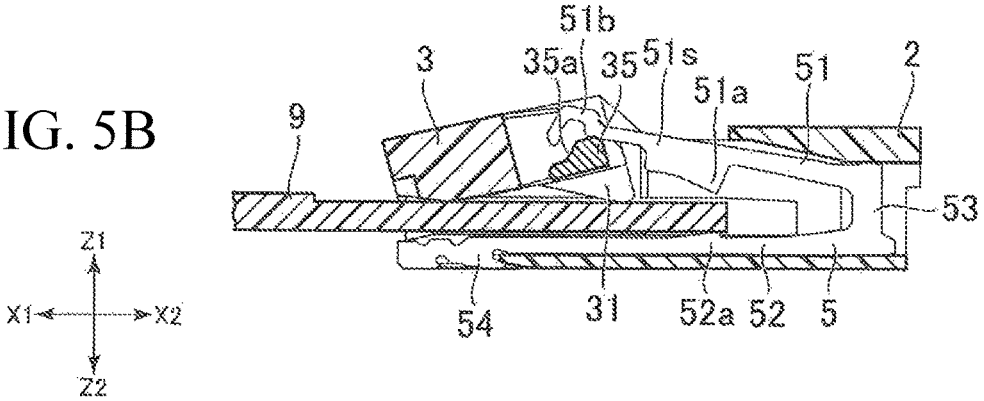
FIG. 5B is the cross-sectional view in FIG. 5A during insertion of the flat cable.

As shown in FIG. 4B and FIG. 5B, the engaging portion 31 formed in the actuator 3 is positioned in the middle of the insertion passage 21 in the longitudinal direction, and comes into contact with and is pushed upward by the end portion 92 of the flat cable 9 in front of the contact portions 51*a* formed in the upper beams 51*a* of the primary terminals 5 when the flat cable 9 is being inserted.

Also, as shown in FIG. 5A and FIG. 5B, a pressure-applying portion 35 is formed in the actuator 3 to push upwards on the upper beams 51 of the primary terminals 5. A hook-shaped receiving portion 51*b* is formed in the upper beam 51 of each primary terminal 5 to receive the pressure from the pressure-applying portion 35. When the engaging portion 31 of the actuator 3 is raised by the end portion 92 of the flat cable 9 (that is, when the actuator 3 moves to the floating orientation), the receiving portion 51*b* of each primary terminal 5 comes into contact with the pressure-applying portion 35 of the actuator 3 and is raised against the elastic force of the primary terminal 5. When the receiving portion 51*b* is raised by the pressure-applying portion 35, the upper beam 51 is lifted with the contact point with the support column portion 53 serving as the fulcrum. Here, the receiving portion 51*b* is positioned in front of the contact portion 51*a*, and the position at which the engaging portion 31 of the actuator 3 comes into contact with the end portion 92 of the flat cable 9 (see FIG. 4B) is positioned to the front of the contact portion 51*a*. Because of the principles of a lever, the force required by the pressure-applying portion 35 to raise the receiving portion 51*b* is less than the force required by the upper surface of the flat cable 9 to raise the contact portion 51*a* in the absence of a pressure-applying portion 35. In the connector 1 of the present embodiment, when a flat cable 9 is inserted, the pressure-applying portion 35 raises the receiving portion 51*b* formed in each upper beam 51. As a result, the force acting on the flat cable 9 from the contact portions 51*a* formed in the upper beams 51 can be reduced. In other words, the force required to insert the flat cable 9 can be reduced.

Also, when the actuator 3 is in the floating orientation as shown in FIG. 4B and FIG. 5B, the receiving portion 51*b* formed in the upper beam 51 of the primary terminals 51 and the pressure-applying portion 35 formed in the actuator 3 are both positioned in front of the position at which the end portion 92 of the flat cable 9 makes contact with the engaging portion 31 of the actuator 3. Here, because the position at which the engaging portion 31 and the end portion 92 make contact is to the rear of the position at which the receiving portion 51*b* and the pressure-applying portion 35 make contact, the actuator 3 is pushed up to the floating orientation at the rear when the flat cable 9 is being inserted. In other words, moment acting on the actuator 3 can be prevented in the direction of the open orientation.

When the actuator 3 is in the floating orientation and the upper beams 51 of the primary terminals 5 have been raised, the contact portions 51*a* formed in the upper beams 51 may or may not make contact with the flat cable 9. When the connector has several terminals, that is, when the connector is a so-called multi-terminal connector, the actuator 3 is raised via the engaging portion 31 provided near the transverse end, and the central portion is bent downward in the transverse direction. As a result, only the contact portions 51*a* of the primary terminals 5 near this portion may make contact with the flat cable 9. Because the primary terminals 5 are raised when the actuator 3 is in the floating orientation, the resistance force can be reduced when the flat cable 9 is being inserted into the connector.

Figure 5C:
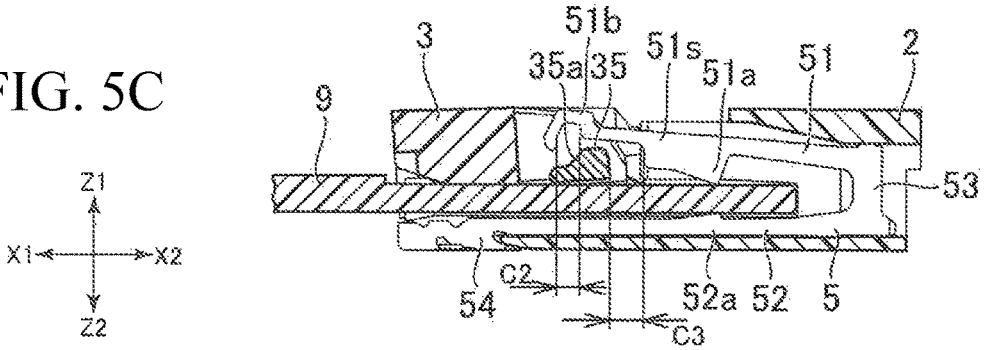
FIG. 5C is the cross-sectional view in FIG. 5A after insertion of the flat cable.

Also, as shown in FIG. 5C, when the flat cable 9 is inserted into the insertion passage 21, the engaging portion 31 on the actuator 3 is fitted into a notch 91 in the flat cable 9 and the actuator 3 is moved to the closed orientation. When the flat cable 9 has been inserted, the contact portions 51*a*, 52*a* formed in the upper beams 51 and the lower beams 52 are positioned inside the insertion passage 21, and the elastic force of the primary terminals 5 presses down on the flat cable 9. Here, when the flat cable 9 has been inserted, the pressure-applying portion 35 of the actuator 3 moves downward away from the receiving portions 51*b* of the upper beams 51. As a result, when the flat cable 9 has been inserted, pressure is maintained between the upper surface of the flat cable 9 and the contact portions 51*a* formed in the upper beams 51. Clearance C3 is provided in the longitudinal direction between the pressure-applying portion 35 and the front edge of the contact point portion 51*s* of the contact portions 51*a*. In this way, the pressure-applying portion 35 is kept from becoming caught on the contact point portions 51*s* and the upper beams 51, and interfering with the actuator 3 in the closed orientation.

As shown in FIG. 6, secondary terminals 6 are arranged inside the housing 2. As in the case of the primary terminals 5, the secondary terminals 6 have an upper beam 61 and a lower beam 62, and the protruding contact portions 61*a*, 62*a* on the leading ends make contact with the flat cable 9. In the secondary terminals 6, a securing portion 64 is also formed to secure the connector 1 to a board (not shown). Unlike the primary terminals 5, the securing portion 64 in the secondary terminals 64 is formed on the rear end of the secondary terminals 6. Also, the upper beams 61 and the lower beams 62 are connected in the rear via support column portions 63 and are configured so that the flat cable 9 is clamped by the elastic force of the secondary terminals 6.

Figure 7A:
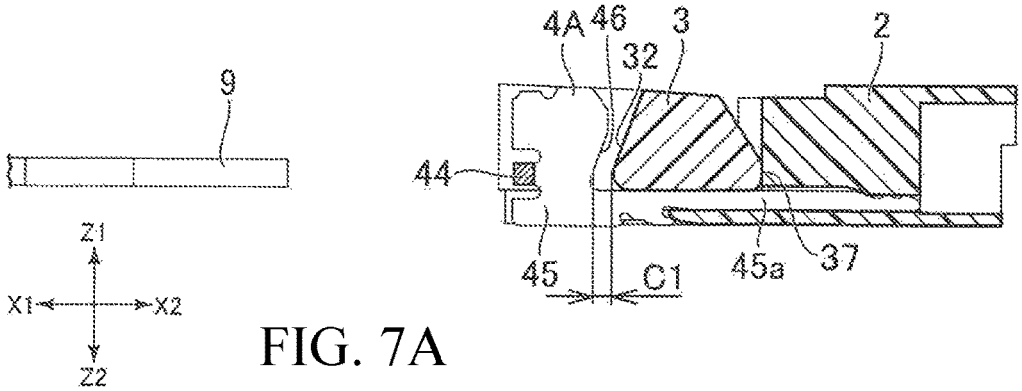
FIG. 7A is a cross-sectional view from VII-VII in FIG. 1.
Figure 8A:
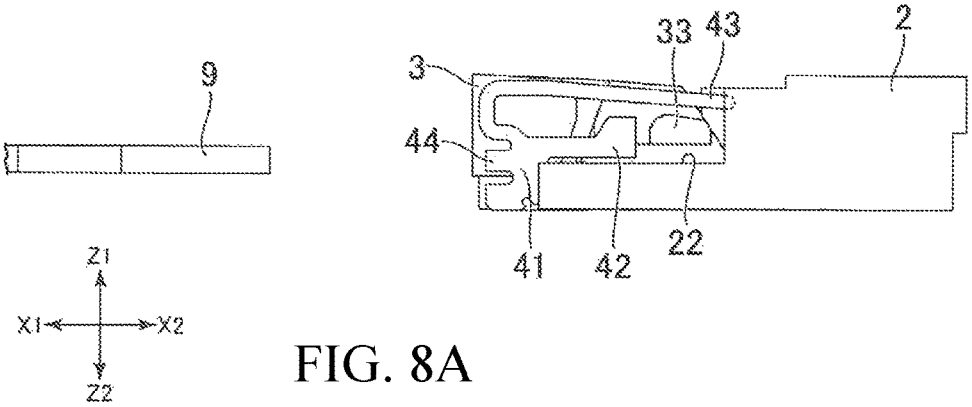
FIG. 8A is a right side view of FIG. 1 before insertion of the flat cable.
Figure 8B:
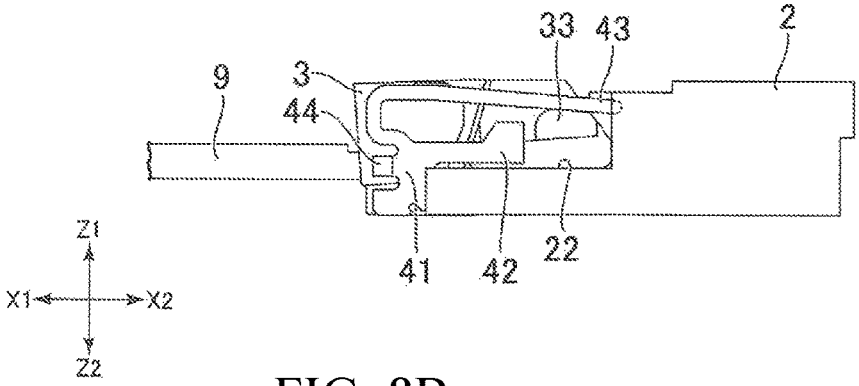
FIG. 8B is the right side view in FIG. 8A after insertion of the flat cable.
Figure 8C:
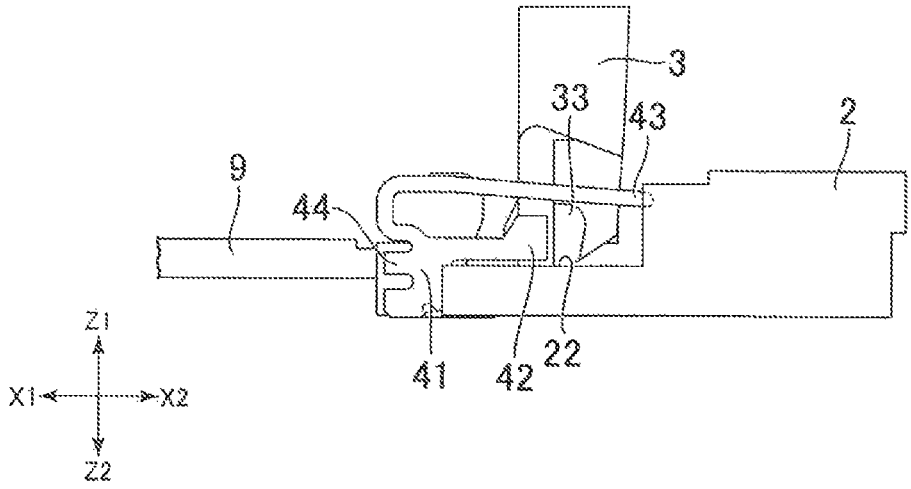
FIG. 8C is the right side view in FIG. 8A showing the actuator in the open orientation.

As shown in FIG. 7A, the holding member 4A is arranged near the left end of the housing 2. The inner plate portion 45 of the holding member 4A includes an inserted portion 45*a* inserted into the housing 2 and a stopping portion 46 including an inclined surface extending upward and to the rear on an incline from near the mounted base of the inserted portion 45*a*. The stopped portion 32 of the actuator 3 also includes an inclined surface extending upward and to the rear on an incline. The stopping portion 46 is arranged in front of the stopped portion 32 of the actuator 3.

Figure 7B:
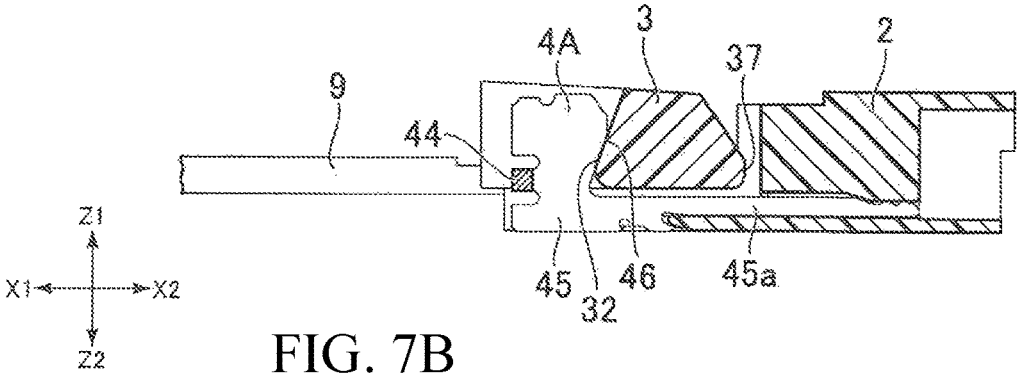
FIG. 7B is the cross-sectional view in FIG. 7A after insertion of the flat cable.
Figure 7C:
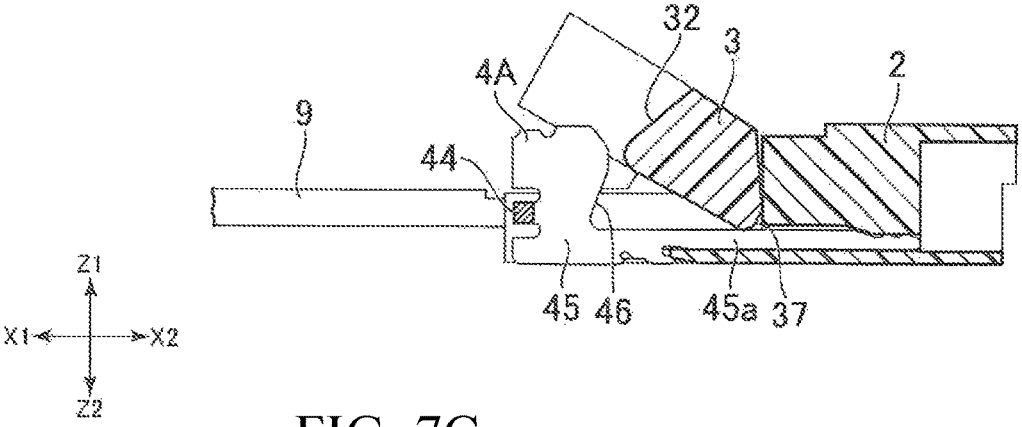
FIG. 7C is the cross-sectional view in FIG. 7A showing the positional relationship between the connector and the flat cable.

As shown in FIG. 7A and FIG. 7B, when a flat cable 9 inserted in the insertion passage 21 is pulled towards the front, the edge 93 formed in the notch 91 of the flat cable 9 pushes against the rear end of the engaging portion 31 of the actuator 3 (see FIG. 4C) and the actuator 3 moves forward.

Here, when the rear end of the engaging portion 31 of the actuator 3 sustains the force from the flat cable 9, moment acts on the actuator 3 in the direction of the open orientation. However, the stopped portion 32 of the actuator 3 comes into contact with the stopping portion 46 formed in the holding member 4A, and movement to towards the front and the open orientation is restricted by the actuator 3 and the stopped portion 32. When movement of the actuator 3 is restricted in the forward direction, the actuator 3 is kept from becoming detached.

More specifically, when the actuator 3 is in the closed orientation, the actuator 3 can move in the longitudinal direction between the position at which the stopped portion 32 comes into contact with the stopping portion 46 (see FIG. 5D and FIG. 7B) and a position at which the stopped portion 32 has moved away from the stopping portion 46 to the rear (see FIG. 5C and FIG. 7A). Here, when the actuator 3 is arranged in the contact position, the inclined surface in the stopping portion 46 comes into contact with the inclined surface in the stopped portion 32, and the stopped portion 32 is pushed towards the floating orientation. This keeps the actuator 3 from rotating from the closed orientation to the open orientation. Because the pressure applied to the stopped portion 32 is released when the actuator 3 is arranged in the separate position, the actuator 3 is able to rotate towards the open orientation. In other words, the operator is prevented from inadvertently opening the actuator 3 but the operation can rotate the actuator 3 towards the open orientation when the actuator 3 is pushed to the rear (see FIG. 7C). Note that, in the present embodiment, the contact position corresponds to the 'first position', and the separated position corresponds to the 'second position'. Also, the stopping portion 46 and the stopped portion 32 do not have to have inclined surfaces. Instead, the stopping portion 46 and the stopped portion 32 may have a tiered surface.

Figure 5D:
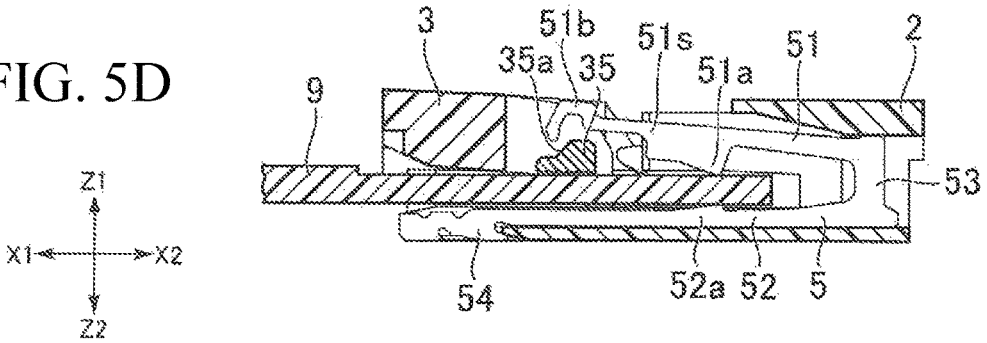
FIG. 5D is the cross-sectional view in FIG. 5A after insertion of the flat cable.

As shown in FIG. 5C, the forward portion of the pressure-applying portion 35 is notched, and the pressure-applying portion 35 includes a tiered portion 35*a* between the front and rear sections. As shown in FIG. 7A and FIG. 5C, when the actuator 3 is arranged in the separate position, the clearance C1 between the separated stopped portion 32 of the actuator 3 and the stopping portion 46 of the holding member 4A in the longitudinal direction is smaller than the clearance C2 between the position in front of the receiving portions 51*b* of the primary terminals 5 and the tiered portion 35*a* in the pressure-applying portion 35 of the actuator 3. Therefore, as shown in FIG. 7B and FIG. 5D, when the flat cable 9 is pulled and the actuator 3 moves forward, the stopped portion 32 of the actuator 3 comes into contact with the stopping portion 46 of the holding member 4A before the pressure-applying portion 35 of the actuator 3 comes into contact with the receiving portions 51*b* of the upper beams 51. In this way, even when the actuator 3 has moved forward, the upper beams 51 of the primary terminals 5 are not pushed upwards. As a result, the upper surface of the flat cable 9 remains pressed against the contact portions 51*a* formed in the upper beams 51. Also, even when the actuator 3 has moved forward, the stopped portion 32 of the actuator 3 comes into contact with the stopping portion 46 of the holding member 4A, and the actuator 3 is prevented from opening in the direction of the open orientation with the pressure-applying portion 35 serving as the axis.

Figure 5E:
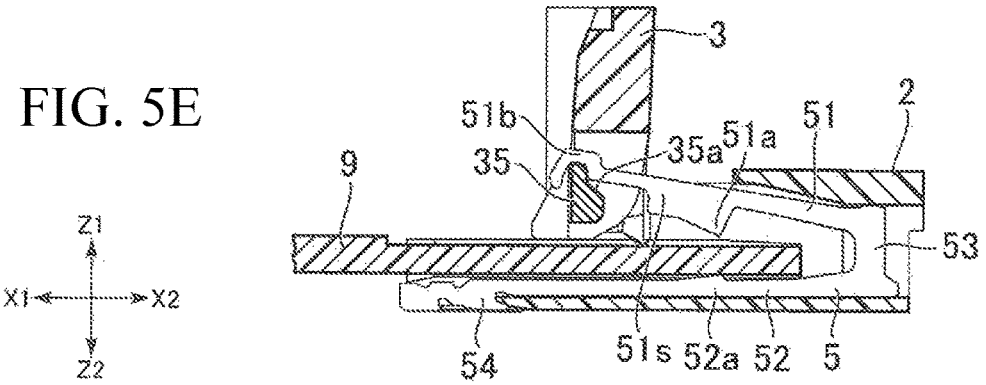
FIG. 5E is the cross-sectional view in FIG. 5A showing the positional relationship between the connector and the flat cable.
Figure 7D:
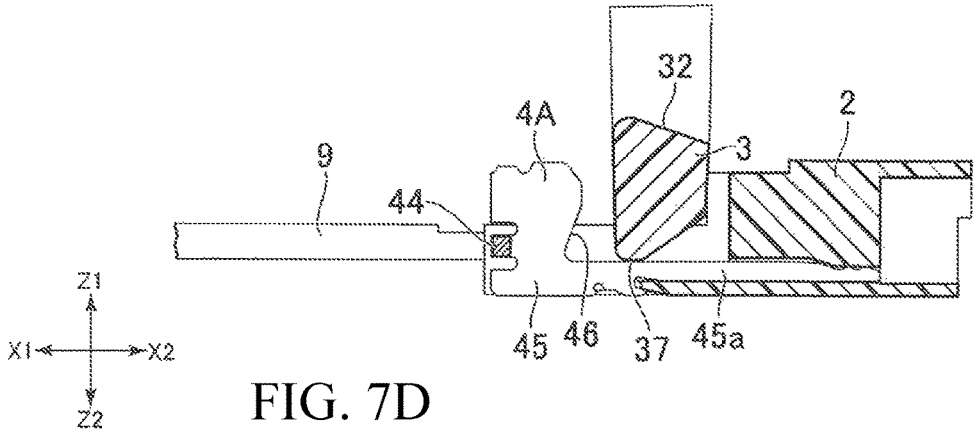
FIG. 7D is the cross-sectional view in FIG. 7A showing the actuator in the open orientation.

As shown in FIG. 5E, the actuator 3 can rotate around the pressure-applying portion 35 between the closed orientation and the open orientation. When the actuator 3 is in the open orientation, the pressure-applying portion 35 of the actuator 3 can push the receiving portions 51*b* of the upper beams 51 upwards against the elastic force of the primary terminals 5. More specifically, as shown in FIG. 8C, when the actuator 3 is in the open orientation, with the upper surface of the supporting portion 22 of the housing 2 serving as the reference, the lower surface of the supported portion 33 of the actuator 33 (contact with the rear surface of the supported portion 33 in FIG. 1) comes into contact with the upper surface. In this way, the pressure-applying portion 35 of the actuator 3 can push up the receiving portions 51*b* of the upper beams 51. Also, as shown in FIG. 4D, when the rear end surface 36 of the actuator 3 comes into contact with the upper surface of the supporting wall 23 of the housing 2, the pressure-applying portion 35 of the actuator 3 can push up the receiving portions 51*b* of the upper beams 51. Also, as shown in FIG. 7D, when the actuator 3 is in the open orientation, with the upper surfaces of the inserted portions 45*a* of the holding members 4A, 4B serving as the reference, the rear end 37 of the actuator 3 comes into contact with the upper surface, and the pressure-applying portion 35 of the actuator 3 is able to push up the receiving portions 51*b* of the upper beams 51. As a result, the interval between the contact portions 51*a* of the upper beams 51 and the contact portions 52*a* of the lower beams 52 can be widened. When the actuator 3 is in the open orientation, the contact portions 51*a* formed in the upper beams 51 move upwards away from the flat cable 9 and the contact pressure on the flat cable 9 is released.

Note that the contact portions 51*a* of the upper beams 51 may or may not come into contact with the flat cable 9. For example, when the connector has several terminals, that is, when the connector is a so-called multi-terminal connector, the pressure-applying portion 35 of the actuator 3 push up the contact portions 51*a* of the upper beams 51 with the upper surface of the supporting portion 22 of the housing 2 provided near the transverse end and the upper surface of the support wall 23 of the housing 2 or the upper surface of the inserted portions 45*a* of the holding members 4A, 4B serving as the reference. However, because the central portion of the actuator 3 in the transverse direction is bent downward, only the contact portions 51*a* of the primary terminals 5 provided in this portion can make contact with the flat cable 9. Because the upper beams 51 of the primary terminals 5 are raised when the actuator 3 is in the open orientation, the resistance of the connector can be reduced during detachment of the flat cable 9. Also, the engaging portion 31 of the actuator 3 and the notch 91 in the flat cable 9 are disengaged. When the actuator 3 is in the open orientation, the operator can easily detach the flat cable 9. The reference for the pressure-applying portion 35 pushing up the receiving portion 51*b* can be set using any position in the housing 2 or can be set using another member.

As shown in FIG. 8A through FIG. 8C, when the actuator 3 is in the open orientation, the stopped portion 33 supported by the supporting portion 22 of the housing 2 is formed in the rear of the actuator 3. Also, a pressing portion 42 and a spring portion 43 are formed in the outer plate portion 41 of the holding member 4A. Also, when the actuator 3 is in the open orientation, the pressing portion 42 is arranged on the front end of the supported portion 33. When the holding member 4A is surrounded by the actuator 3 on the upper end and the front end, the actuator 3 can be kept from rising upward and becoming detached.

Also, as shown in FIG. 8B, when a flat cable 9 is inserted with the actuator 3 in the closed orientation, the rear end of the actuator 3 is pushed up by the thickness of the flat cable 9. Here, the spring portion 43 formed in the holding member 4A biases the upper end of the supported portion 33 of the actuator 3 towards the supporting portion 22 of the housing 2. This keeps the actuator 3 from rattling when the flat cable 9 is inserted.

In the connector 1 of the present disclosure, as mentioned above, the stopping portions 46 formed in the holding members 4A, 4B keep the stopped portion 32 from floating upward. As a result, the operator is kept from inadvertently moving the actuator 3 in the direction of the open orientation. The operator can easily move the actuator 3 to the open position (that is, open orientation) by pushing the actuator 3 to the separate position in the rear.

The present disclosure is not restricted to the embodiment described above. Many variations are possible. For example, a hole can be formed in the flat cable 9 instead of a notch 91, and the engaging portion 31 formed in the actuator 3 can be fitted into the hole.

In the embodiment explained above, the holding members 4A, 4B attached to the housing 2 included stopping portions 46 for restricting forward movement of the actuator 3. However, the stopping portions 46 may be formed integrally in the housing 2. The same can be true of the pressing portions 42 and the spring portions 43 formed in the holding members 4A, 4B.

Also, in the explanation of the present embodiment, the flat cable 9 was inserted into the insertion passage 21 with the actuator 3 in the closed orientation. However, the connector 1 can be inserted into the flat cable 9 with the actuator 3 in the open orientation. In both cases, the stopping portions 46 keep the stopped portion 32 of the actuator 3 from floating upwards. As a result, the operator is prevented from unintentionally opening the actuator 3. Because the actuator 3 in the closed orientation can move in the longitudinal direction, the operator can easily open the actuator 3 by moving the stopped portion 32 away from the stopping portions 46.

The disclosures in the present specification are merely examples of the present disclosure. A person skilled in the art could easily make modifications while preserving the essentials of the present disclosure, and these modifications fall within the scope of the claims. The width, thickness, and shape of each component in the drawings are schematic illustrations and do not limit the interpretation of the present disclosure.

The invention claimed is:

1. A connector comprising:

a housing having an insertion passage for insertion of a flat cable from the front end;

a plurality of terminals arranged inside the housing in a transverse direction, each terminal having an upper beam positioned above the insertion passage;

an actuator having a pressure-applying portion arranged on a lower side of the upper beams, the actuator is configured to rotate about the pressure-applying portion between an open orientation and a closed orientation, the actuator further having a stopped portion; and a holding member secured to the housing, the holding member having a stopping portion, wherein the actuator is movable between a first position and a second position when the actuator is in the closed orientation, wherein the first position is where the stopped portion of the actuator is in contact with the stopping portion, thereby preventing rotation of the actuator from the closed orientation to the open orientation, and wherein the second position is where the stopped portion of the actuator is away from the stopping portion, thereby allowing rotation of the actuator from the closed orientation to the open orientation.

2. The connector according to claim 1, wherein the actuator is configured to move in a longitudinal direction between the first position and the second position when the actuator is in the closed orientation.

3. The connector according to claim 1, wherein the stopping portion is positioned in front of the stopped portion of the actuator.

4. The connector according to claim 1, wherein each upper beam has a receiving portion that is configured to be caught by the pressure-applying portion of the actuator when the actuator is moved from the closed orientation to the open orientation, and wherein the stopped portion of the actuator is configured to contact the stopping portion before the pressure-applying portion of the actuator comes into contact with the receiving portion of each upper beam when the actuator moves forward while in the closed orientation.

5. The connector according to claim 1, wherein at least one of the stopping portion and the stopped portion includes an inclined surface extending upward and rearward and which is configured to contact the other one of the stopping portion and the stopped portion.

6. The connector according to claim 1, wherein each terminal has a contact portion formed in the upper beam and positioned in the insertion passage, and wherein the actuator has an engaging portion positioned in a middle of the insertion passage and which is configured to make contact with an end portion of the flat cable and be pushed up by the end portion of the flat cable in front of the contact portions of the upper beams when the flat cable is being inserted into the insertion passage, and wherein the pressure-applying portion is configured to push the upper beams up against an elastic force of the terminals when the engaging portion has been pushed up.

7. The connector according to claim 1, wherein when the flat cable has been fully inserted into the insertion passage, the pressure-applying portion of the actuator does not contact the upper beams.

8. The connector according to claim 1, wherein the pressure-applying portion of the actuator is configured to push the upper beams up against an elastic force of the terminals when the actuator is in the open orientation.

9. The connector according to claim 1, wherein each upper beam has a receiving portion that is configured to be caught by the pressure-applying portion of the actuator when the actuator is moved from the closed orientation to the open orientation.

10. The connector according to claim 1, wherein each upper beam has a receiving portion, and wherein the stopped portion of the actuator is configured to contact the stopping portion before the pressure-applying portion of the actuator comes into contact with the receiving portion of each beam when the actuator moves forward while in the closed position.

11. The connector according to claim 1, wherein the stopping portion has a rear inclined surface which extends upward and rearward, and wherein the stopped portion has a forward inclined surface which extends upward and rearward, and wherein the rear inclined surface and the forward inclined surface are configured to contact one another.

12. The connector according to claim 1, wherein each terminal has a contact portion formed in the upper beam and which is positioned in the insertion passage.

13. The connector according to claim 12, wherein the actuator has an engaging portion, and wherein, when the flat cable is being inserted into the insertion passage, the engaging portion is configured to make contact with an end portion of the flat cable and be pushed up by the end portion of the flat cable in front of the contact portions of the upper beams.

14. The connector according to claim 1, wherein the actuator has an engaging portion, and wherein, when the flat cable is being inserted into the insertion passage, the engaging portion is configured to make contact with an end portion of the flat cable and be pushed up by the end portion of the flat cable.

15. The connector according to claim 14, wherein the pressure-applying portion is configured to push the upper beams up against an elastic force of the terminals when the engaging portion has been pushed up.

* * * * *